United States Patent [19]

Ogawa

[11] 4,137,666

[45] Feb. 6, 1979

[54] TOY VEHICLE WITH OPTICAL WEAPONS SYSTEM

[75] Inventor: Iwakichi Ogawa, Kashiwa, Japan

[73] Assignee: Takara Co., Ltd., Tokyo, Japan

[21] Appl. No.: 774,960

[22] Filed: Mar. 7, 1977

[51] Int. Cl.[2] ..... A63H 17/00

[52] U.S. Cl. ..... 46/202

[58] Field of Search ..... 46/76, 78, 202, 256, 46/1 E

[56] References Cited

U.S. PATENT DOCUMENTS

| | | | |
|---|---|---|---|
| 1,348,971 | 8/1920 | Thurnau | 46/78 |
| 3,148,478 | 9/1964 | Miller | 46/202 |
| 3,181,271 | 5/1965 | Withams | 46/202 |
| 3,314,289 | 4/1967 | Carroll | 46/256 |

*Primary Examiner*—Louis G. Mancene
*Assistant Examiner*—Robert F. Cutting
*Attorney, Agent, or Firm*—Harold L. Jackson; Stanley R. Jones; Joseph W. Price

[57] ABSTRACT

A toy vehicle includes an optical sighting system having a lens, a focusing screen upon which images are focused by the lens, and a mirror to invert and transmit the images upward out of the toy body to a viewer. The toy vehicle further includes a complementarily firing mechanism for launching a plurality of projectiles at sighted targets. Additionally, the toy vehicle can also support a detachable plane-like device which includes a wing, a propeller, and a means to drive the propeller.

11 Claims, 3 Drawing Figures

TOY VEHICLE WITH OPTICAL WEAPONS SYSTEM

BACKGROUND OF THE INVENTION

1. Field of the Invention

The present invention is directed to the toy field and more particularly to a toy vehicle incorporating an optical sighting system.

2. Brief Description of the Prior Art

Various forms of toy vehicles have been provided for children. Frequently these vehicles have incorporated removable parts and various forms of projectile firing mechanisms. The prime purpose in most of these toys is simply to simulate a firing of a projectile for play action by the children. The aggressive nature of children coupled with the skill involved in aiming has traditionally attracted them to this form of toy and if the toy is designed within safety parameters, the resultant enjoyment of the toy provides an acceptable satisfaction of the child's aggression.

Since a child's span of attention is somewhat limited, there is a continual demand in the prior art to provide novel features to these form of toys at a relatively economical cost.

SUMMARY OF THE INVENTION

The present invention is directed to a toy vehicle having a firing mechanism that is capable of cooperating with an optical sighting or fire control system. The firing mechanism can launch a plurality of projectiles at a selected target. The optical system is capable of locating and focusing on a target object at a distance from the toy within range of the firing mechanism. A lens element and means for focusing the object on a translucent screen is further provided. A mirror is used to invert the image and transmit it to a convenient location for the child to coordinate the firing mechanism. Additionally, a detachable plane member can be supported on the toy vehicle to further supplement the play options available to the child.

DESCRIPTION OF THE PREFERRED EMBODIMENT

The following description is provided to enable any person skilled in the toy industry to made and use the invention and it sets forth the best mode contemplated by the inventor of carrying out this invention. Various modifications, however, will remain readily apparent to those skilled in the above art, since the generic principles of the present invention have been defined herein specifically to provide a relatively economical and easily manufactured toy vehicle assembly.

Figure 1:
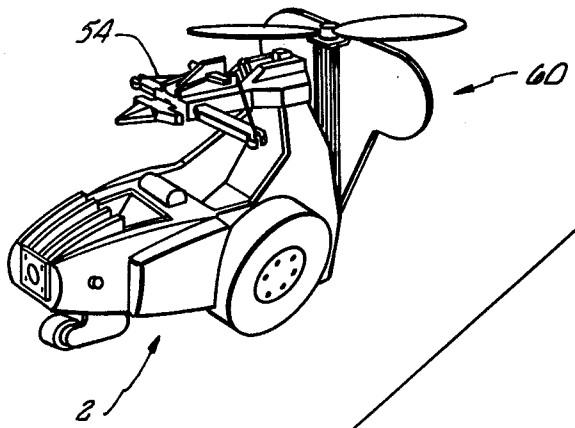
FIG. 1 is a perspective view of an assembled toy vehicle of the present invention.

Referring to FIG. 1, the toy vehicle assembly 2 includes a tricycle vehicle housing or body member 4 which is preferably formed from injection molded plastic. Various surface serrations and design configurations can be included on the housing member 4 to further enhance its appearance. As operator seat or cavity is provided on the housing member to optionally receive a toy doll figure. Molded into the housing member 4, about its body, are various cylindrical recesses which can operate as female coupling parts to receive corresponding male shafts of various appendages for attachment to the vehicle housing.

Figure 2:
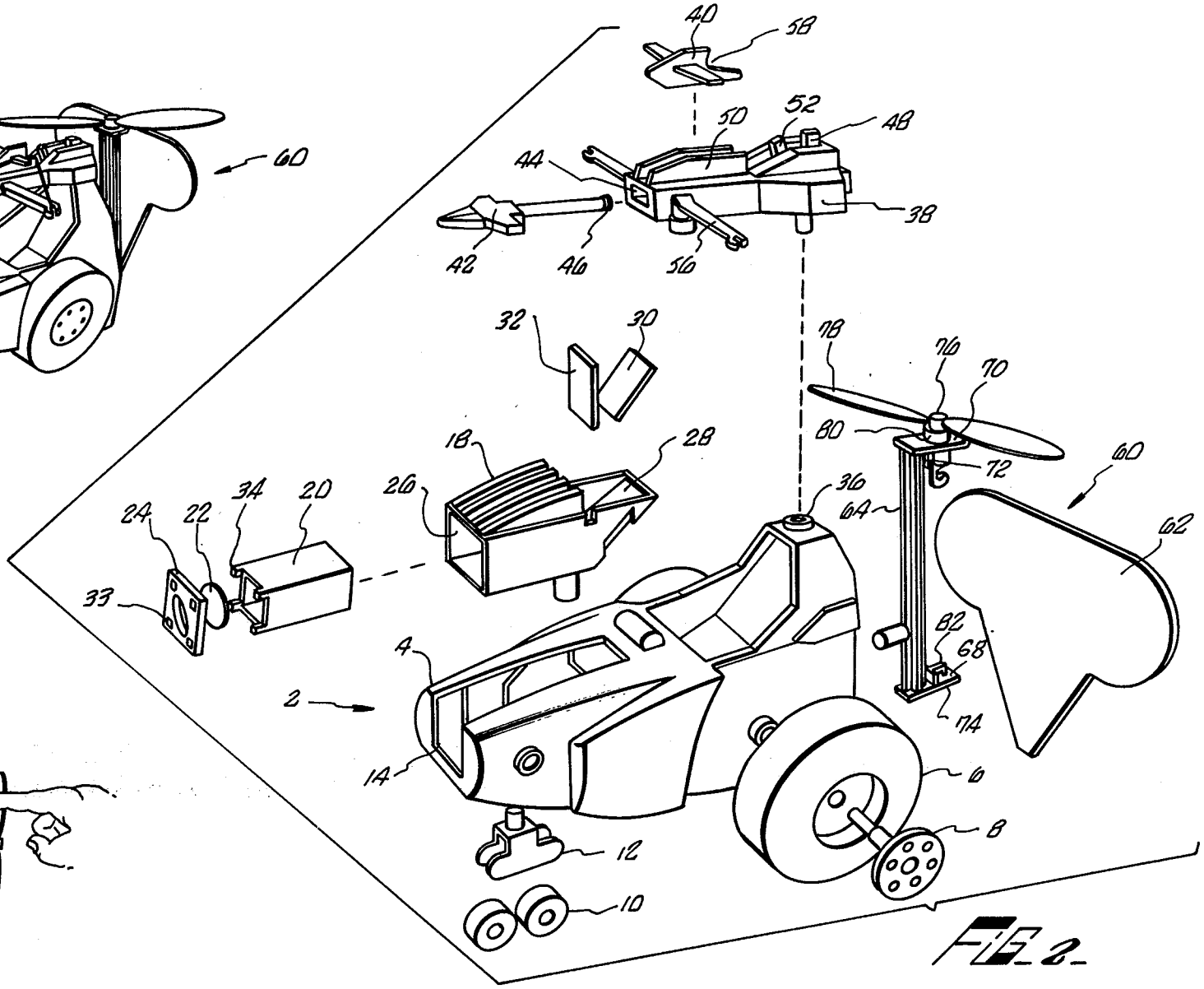
FIG. 2 is an exploded perspective view of the embodiment of FIG. 1.

As can be seen in the exploded view of FIG. 2, various attachments can be incorporated onto the housing member 4 to provide an operative assembly. Large rear wheels 6, also formed from molded plastic can be attached by hub shafts 8 directly to the side of the housing member 4. The wheels 6, can rotate freely while supporting the rear of the housing member 4.

A pair of small front wheels 10 can be snap-mounted to a dolly carriage housing member 12 which is in turn mounted via a male shaft into a female recess (not shown) at the bottom of housing member 4.

The front portion of the housing member 4 has an upper slotted cavity 14 with appropriate support notches that can receive and support a fire control optical system 16. The fire control optical system 16 includes an optical housing member 18, a lens barrel 20, a biconvex focusing lens 22 and a snap-mounting lens retainer 24. The lens barrel 20 has an exterior complimentary shape to that of an aperture 26 within the optical housing member 18 to permit relative movement. In the preferred embodiment, the aperture and exterior configuration of the lens barrel 20 has a square shape. As can be recognized, other configurations such as round could just as easily be utilized. Four prong retainers 34 extend from the front end of the lens barrel 20 and can coact with appropriate holes 33 in the lens retainer 24 for mounting the focusing lens 22.

Intercepting the axis of the aperture 26, is an inclined support surface 28, forming roughly a 45-degree angle with the axis. Mounted on this support surface 28 is a reflector such as a mirror 30 to reflect the optical axis on a 90-degree angle to the housing member 18.

Transverse slots, relative to the axis of the aperture 26 (not shown) are molded into the optical housing member 18 adjacent the inclined forward end of the mirror 30 in the optical housing member 18. A translucent screen 32 is mounted in these transverse slots and provides an imaging plane for realizing the image of a preselected target object with the focusing lens 22.

During assembly, the mounting holes 33 in the lens retainer plate 24 are designed to be snap fitted over the male prongs 34 cantilevered from one end of the lens barrel 20. The focusing lens 22 is captured and held in place between the retainer plate 24 and the pronged end of the lens barrel 20. The lens 22 can be formed from a molded acrylic plastic with relatively large optical tolerance properties.

The rear top of the vehicle housing member 4 includes a female recess 36 for receiving the male member of a firing housing mechanism 38. The firing housing mechanism 38 supports two separate projectiles 40 and 42. In the illustrated embodiment the projectile 43 has a spear-like configuration and is designed to be mounted within an aperture 44 in the front of the housing mechanism 38. Mounted within the interior of the housing mechanism is a spring, as known in the prior art and not shown, which can be compressed when the spear projectile is inserted into the aperture 44. A latching mechanism (not shown) is capable of locking onto an indent 46 at the rear end of the spear projectile 42. A first trigger 48 is connected to the latching mechanism and is capable of releasing the spear projectile 42 so it can be propelled by the force of the spring. Preferably the tip of the projectile 42 is appropriately designed either in configuration or from material to be relatively safe for use with children.

A dart projectile 40 is mounted within a pair of guide rails 50, on the top of the firing housing mechanism 38. A second trigger 52 is pivotally mounted on the firing housing mechanism and controls a resilient member such as a rubber band 54 mounted on a cross-bow arm 56 and held in a state of stress by the rear edges of the guide rails 50. The pivoted second trigger 52 extends beneath and between the guide rails 50 and upon a rearward movement of the trigger 52 the rubber band 54 can be released. The dart projectile 42 further includes a rear cutaway impact portion 58 which can receive the impact force of the released rubber band 54.

An airplane assembly 60 is removably mounted on the rear portion of the vehicle housing member 4. The plane assembly 60 basically comprises a wing member 62 formed from a single piece of lightweight relatively rigid material such as a compressed styrofoam plastic. A body support frame 64 includes a longitudinal support beam 66 having end support plates 68 and 70. A retainer plate 72 and 74 is further mounted adjacent each respective end support plate to removably retain the wing member 62.

Figure 3:
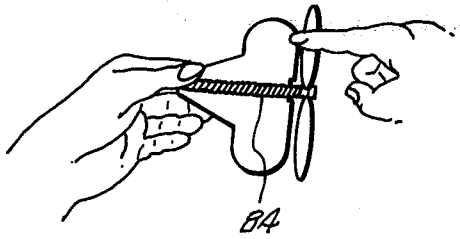
FIG. 3 is a schematic perspective view disclosing the operation of a plane member.

A propeller mounting shaft 76 has a bifurcated hooked end for removingly retaining a propeller member 78 at one end and a hooked configuration at the other end. A bearing washer 80 separates the propeller blade 78 from the end of the retainer plate 72. A resilient member such as a rubber band 84 can be mounted on the hooked end of the propeller shaft 76 and also mounted on another hooked retainer 82 mounted on the retainer plate 74. When the rubber band 84 is placed under tension by winding as shown in the perspective view of FIG. 3, energy is stored. When the propeller is released, the rubber band unwinds and drives the propeller to provide a forward thrust to permit flight.

The optic sighting system 16 is capable of focusing a target object for remote viewing by the child above the projectile firing mechanism 38. With the firing mechanism 38 aligned with the optical sighting system, a child can center a target image on the focusing screen and then fire either of the projectiles 40 and 42 which will hit the target. Because the lens barrel 20 is movable relative to the optical housing member 18, the focusing lens 22 can be moved relative to the housing member 18 to insure that the target image will be realized on the imaging screen 32. The firing mechanism 38 is also capable of being manually sighted in a 360-degree direction about the vehicle housing 4.

The objects and features of the present invention which are believed to be novel are set forth with particularity in the appended claims. Various modifications of the present invention can be accomplished herein by a skilled designer and accordingly the present invention should be measured solely from the following claims in which we claim:

What is claimed is:

1. A multifunction mobile toy assembly comprising;

a housing member;

a projectile firing system mounted on the housing member;

means attached to the housing member for providing locomotion;

optical means operatively associated with the housing member for imaging an object including an imaging screen disposed for exterior viewing whereby the projectile firing system can be aligned with target images for discharging projectiles at the target.

2. The invention of claim 1 wherein the optical means further includes a relatively movable lens system for transmitting and focusing an image of the object on the imaging screen.

3. The invention of claim 1 further including mounting means on the housing for positioning the optical means to image a target object within range of the projectile propelling means and along the firing line of the propelling means.

4. The invention of claim 2 further including an inclined reflector for inverting and rectifying the image focused on the screen by the optical means.

5. The invention of claim 4 wherein the optical means further includes a biconvex lens for focusing images onto the screen.

6. The invention of claim 1 wherein the optical means includes;

a biconvex lens;

a hollow lens barrel member open at opposite ends;

a retainer with a central hole attachable to the lens barrel member at a first end to mount the lens concentric with the hole;

a hollow housing member into which the lens barrel is movably inserted, the imaging screen being positioned adjacent the lens barrel second end; and a reflector inserted into the hollow housing member at an angle to the imaging screen to invert and transmit any image focused on the screen by the lens out of the hollow housing member to a viewer.

7. The invention of claim 1 further including a second projectile firing system.

8. The invention of claim 1 wherein the housing member is configured to simulate a tricycle body and the locomotion means includes two rear wheels and a smaller front dolly carriage housing member.

9. The invention of claim 1 further including a detachable rear airplane assembly including a wing member; a propeller; means for powering the propeller, and a support frame removably mounting the wing member, the propeller and the means for powering the propeller, the support frame removably attached to the rear of the housing member as a subunit and capable of being separately flown as a subunit.

10. The invention of claim 9 wherein the support frame further includes a pair of retainer plates for supporting the wing member, a propeller support plate at one end, and a shaft connected to the propeller and extending through the support plate for connection to the power means.

11. A toy vehicle assembly comprising;

a vehicle housing member;

a projectile firing assembly mounted on the exterior of the vehicle housing member including a projectile;

means attached to the vehicle housing member for providing locomotion;

a hollow optical housing member mounted on the vehicle housing member having a first and second opening;

a lens barrel member movably mounted in the hollow optical housing member;

a focusing lens mounted in the lens barrel member;

an imaging screen mounted adjacent one end of the lens barrel, and a reflector inserted into the hollow housing member at an angle to the imaging screen to transmit an image of a target upward out of the hollow housing member to permit alignment of the projectile firing assembly to fire the projectile at the target, the lens barrel movement permitting an operator to focus on the target.

* * * * *

UNITED STATES PATENT AND TRADEMARK OFFICE

CERTIFICATE OF CORRECTION

PATENT NO. : 4,137,666

DATED : February 6, 1979

INVENTOR(S) : IWAKICHI OGAWA

It is certified that error appears in the above-identified patent and that said Letters Patent are hereby corrected as shown below:

In Col. 1, line 67 delete "As" and insert --An--.

In Col. 2, line 57 delete "43" and insert --42--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*